US009587192B2

(12) United States Patent
Swensen et al.

(10) Patent No.: US 9,587,192 B2
(45) Date of Patent: Mar. 7, 2017

(54) VIBRATION ASSISTED VACUUM DEWATERING OF FINE COAL PARTICLES

(71) Applicant: OMNIS MINERAL TECHNOLOGIES, LLC, Santa Barbara, CA (US)

(72) Inventors: James S. Swensen, Santa Barbara, CA (US); Simon K. Hodson, Santa Barbara, CA (US); Jonathan K. Hodson, Santa Barbara, CA (US)

(73) Assignee: EARTH TECHNOLOGIES USA LIMITED, Santa Barbara, CA (US)

( * ) Notice: Subject to any disclaimer, the term of this patent is extended or adjusted under 35 U.S.C. 154(b) by 130 days.

(21) Appl. No.: 14/586,685

(22) Filed: Dec. 30, 2014

(65) Prior Publication Data

US 2015/0184099 A1 Jul. 2, 2015

Related U.S. Application Data

(60) Provisional application No. 61/922,374, filed on Dec. 31, 2013, provisional application No. 61/985,721, filed on Apr. 29, 2014.

(51) Int. Cl.
*C10L 5/02* (2006.01)
*C10L 5/04* (2006.01)
(Continued)

(52) U.S. Cl.
CPC *C10L 5/04* (2013.01); *C10L 5/08* (2013.01); *C10L 5/363* (2013.01); *C10L 5/26* (2013.01);
(Continued)

(58) Field of Classification Search
CPC ..... C10L 9/00; C10L 9/08; C10L 2290/08; C10L 5/02
(Continued)

(56) References Cited

U.S. PATENT DOCUMENTS 3,970,549 A 7/1976 Ennis et al.
4,257,879 A * 3/1981 Bogenschneider ..... B03B 9/005 209/1
(Continued)

FOREIGN PATENT DOCUMENTS

CN 1500752 A 6/2004

*Primary Examiner* — Ellen McAvoy
(74) *Attorney, Agent, or Firm* — Kirton McConkie; Evan R. Witt

(57) ABSTRACT

Fine coal particles are dewatered by mechanically removing water from the coal particles by vibration assisted vacuum dewatering to form a coal particle filter cake. The filter cake typically has a water content less than 35% by weight, suitable for extrusion to form discrete, non-tacky pellets. The vibration assisted vacuum dewatering may operate at a vibration frequency in the range from about 1 Hz to about 500 Hz. The vibration frequency may be adjusted during the dewatering process. In some embodiments, the vibration frequency is increased as the moisture content of the coal particle filter cake is decreased. Washing the filter cake during dewatering removes soluble contaminants. Various vibration assisted vacuum dewatering devices may be used, including a vibration assisted rotary vacuum dewatering drum, a vibration assisted vacuum disk filter, and a vibration assisted vacuum conveyor system.

37 Claims, 9 Drawing Sheets

(51) Int. Cl.
*C10L 5/08* (2006.01)
*C10L 5/36* (2006.01)
*C10L 5/26* (2006.01)

(52) U.S. Cl.
CPC ..... *C10L 2250/06* (2013.01); *C10L 2290/08* (2013.01); *C10L 2290/547* (2013.01)

(58) Field of Classification Search
USPC ..... 44/626
See application file for complete search history.

(56) References Cited

U.S. PATENT DOCUMENTS 4,419,249 A 12/1983 Bolton et al.
4,687,490 A 8/1987 Heaton, III et al.
5,402,894 A 4/1995 Winterhoff
5,458,786 A * 10/1995 Yoon ..... B03B 1/04 209/5
5,771,601 A * 6/1998 Veal ..... B04B 3/06 210/360.1
5,795,484 A 8/1998 Greenwald, Sr.
5,956,858 A * 9/1999 Veal ..... F26B 5/08 34/138
6,440,316 B1 * 8/2002 Yoon ..... B04B 3/00 210/369
6,526,675 B1 * 3/2003 Yoon ..... F26B 5/005 210/770
6,599,434 B2 7/2003 Mullins
6,855,260 B1 * 2/2005 Yoon ..... B03D 1/08 209/5
7,820,058 B2 10/2010 Yoon
9,004,284 B2 * 4/2015 Bland ..... F26B 25/04 209/3
2003/0146167 A1 * 8/2003 Miller ..... B03B 9/005 210/710
2011/0078917 A1 * 4/2011 Bland ..... C10B 57/10 34/354
2013/0111808 A1 * 5/2013 Yoon ..... B03B 1/04 44/505
2013/0340328 A1 * 12/2013 Yoon ..... C10L 9/10 44/505
2014/0144072 A1 * 5/2014 Bland ..... C10B 57/10 44/626
2016/0047598 A1 * 2/2016 Bland ..... F26B 5/16 34/356

* cited by examiner

VIBRATION ASSISTED VACUUM DEWATERING OF FINE COAL PARTICLES

CROSS-REFERENCE TO RELATED APPLICATIONS

This application claims the benefit of U.S. Provisional Patent Application No. 61/922,374, filed Dec. 31, 2013, titled VIBRATION ASSISTED VACUUM DEWATERING OF COAL FINES and the benefit of U.S. Provisional Patent Application No. 61/985,721, filed Apr. 29, 2014, titled CAMSHAFT MECHANISM FOR APPLYING VIBRATION TO THE SURFACE OF FILTER CAKE, which applications are incorporated by reference.

BACKGROUND OF THE INVENTION

This disclosure relates to systems and methods for dewatering fine coal particles to form a filter cake. More specifically, the disclosed systems and methods include vibration assisted vacuum dewatering of fine coal particles.

BACKGROUND

Coal is one of the most important energy sources in the world. There are many grades of coal based on the ash content, moisture, macerals, fixed carbon, and volatile matter. Regardless of grade however, the energy content of coal is directly correlated to its moisture and ash-forming mineral contents. The lower the ash-forming mineral and moisture content of the coal, the greater the energy content, and the higher the value of the coal.

Approximately 1 billion tons of coal are produced in the United States each year. Coal is typically crushed. During the mining and crushing operation, coal waste fines, also known as coal dust, are generated. Furthermore, coal is typically washed prior to transport to remove surface dust. Coal fines are defined as coal that is less than 1 millimeter in size, and coal ultrafines are defined as coal that is less than 500 microns in size. The current industrial process to recover coal particles less than 1 mm in size is more expensive than other coal processing. The smaller the particles, the greater the processing cost. Further, there are no current commercial processes to recover and sell particles less than 100 microns (0.1 mm). Approximately 200 to 300 million tons of coal waste fines are produced and impounded each year in the United States. It is estimated that over 3 billion tons of coal are produced in China each year, and over 500 million tons of associated coal fines are impounded each year.

While coal dust (fines) is the same composition of the other mined product, it is considered waste because the conventional coal recovery process is not designed to handle small particles. The waste coal dust is left unused because it is typically too wet to burn, too dirty to be worth drying, and too fine to transport. There are billions of tons of waste coal dust at thousands of coal mines throughout the world. It is estimated there are over 10 billion tons in the United States and China, and billions of additional tons in Australia, India, Indonesia, Russia, Columbia and other countries.

While coal fines separation, classification and drying technologies are known, they are too inefficient and expensive with particles less than 150 microns to be commercially feasible. An efficient process to convert coal fines into an economical commercial product has not been developed. Further significant money is being wasted in the transportation and handling of the moisture fraction and the ash-forming mineral fraction of the coal.

In summary, the coal industry has designed their process with particles less than 0.5 mm discarded as waste. This waste accounts for 20% to 30% of all coal production. Even with recent advances in some coal processes, including attempts to recover coal fines via coal flotation processes, the coal industry does not have an effective process for upgrading and handling coal fines less than 500 microns (0.5 mm), more specifically less than 300 microns (0.3 mm), less than 150 microns (0.15 mm), less than 100 microns (0.1 mm), and certainly less than 50 microns (0.05 mm). These massive amounts of fine waste are an inefficiency caused by current coal industry practices and are an environmental and disposal problem.

It would be a significant advancement in the art to provide an efficient process to mechanically dewater fine coal particles to an extent sufficient for further processing.

BRIEF SUMMARY OF THE INVENTION

This disclosure relates to systems and methods for vibration assisted vacuum dewatering of fine coal particles to form a filter cake.

When considering the cost of dewatering particles less than 2 mm in diameter from a suspension, slurry, or froth as part of a manufacturing process, it is desirable to remove as much water as possible through a combination of the cheapest and fastest means that fits into the process flow and time constraints. There are three general dewatering processes: gravity dewatering, such as settling; mechanical dewatering, such as filtration; and thermal dewatering, such as heating. The relative manufacturing process cost for dewatering a material proceeds as gravity dewater cost <mechanical dewatering cost <thermal dewatering cost.

Gravity dewatering will produce a pumpable slurry that is approximately 50 wt. % solids. In order to dewater the slurry further, mechanical or thermal dewatering is required. For complete dewatering of a slurry, e.g. less than 3 wt. % moisture, the more water that can be removed from the slurry suspension to produce a solid cake via a mechanical process, the less water needs to be removed thermally to reach the target moisture content of the final product.

This invention discloses vibration assisted vacuum dewatering as a method to dewater suspensions, slurries, and froths more than is possible with traditional vacuum dewatering alone or other mechanical dewatering methods.

The disclosed invention is useful to dewater overflow froth produced during flotation separation of hydrophobic and hydrophilic minerals, where the solid particles in the overflow froth are hydrophobic in nature and the hydrophilic particles have been largely removed through the flotation separation process, being left behind in the pulp of the flotation column. The disclosed invention is particularly used to dewater the hydrophobic particles in the coal-froth obtained from flotation separation of fine coal particles.

One disclosed process for removing water from coal particles includes the step of obtaining a quantity of coal particles collected from coal fines that were processed to remove ash-forming component particles. Such coal particles would typically be in the coal-froth obtained from flotation separation of fine coal particles. The coal particles have a particle size less than about 500 μm. In one non-limiting embodiment, the coal particles have a particle size less than about 300 μm. In still another non-limiting embodiment, the coal particles have a particle size less than about 150 μm. In yet another non-limiting embodiment, the coal particles have a particle size less than about 100 μm. In a further non-limiting embodiment, the coal particles have a particle size less than about 75 μm.

The coal particles are dewatered by mechanically removing water from the coal particles by vibration assisted vacuum dewatering to form a coal particle filter cake. The filter cake will typically have a water content less than 35% by weight. In some embodiments, the filter cake has a water content less than 30% by weight. In other embodiments, the filter cake has a water content less than 25% by weight. The water content of the filter cake following vibration assisted vacuum dewatering is related to the particle size distribution of the coal particles. For instance, larger coal particles can be dewatered to a lower water content compared to smaller coal particles. Without being bound by theory, it is believed smaller coal particles have higher surface area with a corresponding high amount of water bound to the surface area.

The filter cake may be washed with wash water, such as by a fine mist, during dewatering to remove soluble contaminants from the filter cake. Non-limiting examples of soluble contaminants include salts, such as sulfate salts and sodium chloride, found associated with mined coal.

In one non-limiting embodiment, the vibration assisted vacuum dewatering operates at a vibration frequency in the range from about 1 Hz to about 20,000 Hz. In other non-limiting embodiments, the vibration frequency is in the range from about 1 Hz to about 10,000 Hz. In another non-limiting embodiment, the vibration assisted vacuum dewatering operates at a vibration frequency in the range from about 1 Hz to about 5,000 Hz. In still other non-limiting embodiments, the vibration frequency is in the range from about 1 Hz to about 1000 Hz. In yet another non-limiting embodiment, the vibration frequency is in the range from about 1 Hz to about 500 Hz. The minimum vibration frequency can be greater than 1 Hz. For instance, the vibration frequency can be greater than 10 Hz. The vibration frequency can be greater than 25 Hz. In some embodiments, the vibration frequency may be adjusted during the dewatering process. For example, in some non-limiting embodiments the vibration frequency is increased as a moisture content of the coal particle filter cake is decreased.

The vibration assisted vacuum dewatering process may utilize any suitable vacuum dewatering apparatus. In one non-limiting embodiment, the water is mechanically removed using a vibration assisted rotary vacuum dewatering drum. In another non-limiting embodiment, the water is mechanically removed using a vibration assisted vacuum disk filter. In yet another non-limiting embodiment, the water is mechanically removed using a vibration assisted vacuum conveyor system.

The disclosed vibration assisted vacuum dewatering process preferably operates to produce a coal particle filter cake that has a water content suitable for extrusion to form discrete, non-tacky pellets.

The disclosed vibration assisted vacuum dewatering process includes the steps of forming a filter cake and drying, or dewatering, the filter cake. The water removal rate during cake formation time is nearly the same as the initial water removal rate during the drying time. This is believed to occur because the vibration causes water to fill the void space between solid particles so that water is continually removed without pulling air through the filter cake.

In a disclosed embodiment, the water removal rate from the filter cake during the first 15 seconds of drying is greater than 1 $l/m^2/min$. In another disclosed embodiment, water is removed from the filter cake during the first 15 seconds of drying at a rate greater than 1.5 $l/m^2/min$. In another disclosed embodiment, water is removed from the filter cake during the first 15 seconds of drying at a rate greater than 2 $l/m^2/min$. In still another disclosed embodiment, water is removed from the filter cake during the first 15 seconds of drying at a rate greater than 3 $l/m^2/min$. In yet another disclosed embodiment, water is removed from the filter cake during the first 15 seconds of drying at a rate greater than 4 $l/m^2/min$.

In some disclosed embodiments, greater than 10 wt. % of the water remaining in the filter cake at the start of the drying time is removed from the filter cake in first 15 seconds of drying time with vibration assisted vacuum dewatering. In another disclosed embodiment, greater than 20 wt. % of the water remaining in the filter cake at the start of the drying time is removed from the filter cake in first 30 seconds of drying time with vibration assisted vacuum dewatering. In still another disclosed embodiment, greater than 20 wt. % of the water remaining in the filter cake at the start of the drying time is removed from the filter cake in first 60 seconds of drying time with vibration assisted vacuum dewatering. In yet another disclosed embodiment, greater than 30 wt. % of the water remaining in the filter cake at the start of the drying time is removed from the filter cake in first 60 seconds of drying time with vibration assisted vacuum dewatering. In a further disclosed embodiment, greater than 30 wt. % of the water remaining in the filter cake at the start of the drying time is removed from the filter cake in first 120 seconds of drying time with vibration assisted vacuum dewatering.

In some non-limiting embodiments, the average dewatering rate is greater than 2.3 $l/m^2/min$ for a dewatering time of 2 min. In other non-limiting embodiments, the average dewatering rate is greater than 1.5 $l/m^2/min$ for a dewatering time of 3 min.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
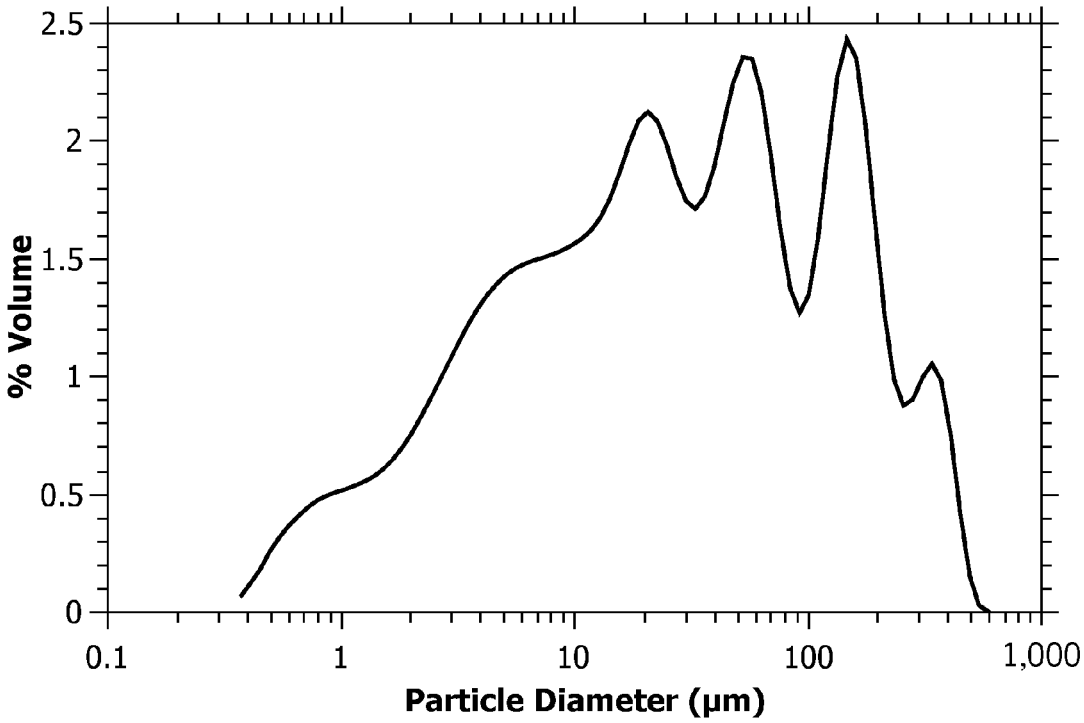
FIG. 1 shows a particle size distribution for coal particles on a dry basis in coal-froth used in Example 1.

The present embodiments of the disclosed invention will be understood by reference to the drawings, wherein like parts are designated by like numerals throughout. It is understood that the components of the present invention, as generally described and illustrated in the figures herein, could be arranged and designed in a wide variety of different configurations. Thus, the following more detailed description of the embodiments of the invention is not intended to limit the scope of the invention, as claimed, but is merely representative of present embodiments of the invention.

One aspect of the disclosed invention relates to dewatering the hydrophobic particles in coal-froth obtained from flotation separation of fine coal particles. In one non-limiting embodiment, the coal particles have a particle size less than about 500 μm. In another non-limiting embodiment, the coal particles have a particle size less than about 300 μm. In still another non-limiting embodiment, the coal particles have a particle size less than about 150 μm. In yet another non-limiting embodiment, the coal particles have a particle size less than about 100 μm. In a further non-limiting embodiment, the coal particles have a particle size less than about 75 μm.

The coal particles are dewatered by mechanically removing water from the coal particles by vibration assisted vacuum dewatering to form a coal particle filter cake. The filter cake will typically have a water content less than 35% by weight. In some non-limiting embodiments, the resulting filter cake has a water content less than 30% by weight. In other non-limiting embodiments, the resulting filter cake has a water content less than 25% by weight. The water content of the filter cake following vibration assisted vacuum dewatering is related to the particle size distribution of the coal particles. Larger coal particles can be dewatered to a lower water content compared to smaller coal particles. Without being bound by theory, it is believed smaller coal particles have higher surface area with a corresponding high amount of water bound to the surface area.

In one non-limiting embodiment, the vibration assisted vacuum dewatering operates at a vibration frequency in the range from about 1 Hz to about 500 Hz. Higher frequencies may be used in some embodiments, including a vibration frequency as high as 1000 Hz, as high as 5,000 Hz, as high as 10,000, and even as high as 20,000 Hz. The lower vibration frequency value may be greater than 1 Hz. For instance, the vibration frequency can be greater than 10 Hz. The vibration frequency can be greater than 25 Hz. The vibration frequency may be adjusted during the dewatering process such that the vibration frequency increases as the moisture content of the coal particle filter cake decreases.

Any suitable vacuum dewatering apparatus, adapted to include vibration to the filter cake surface, may be used. In one non-limiting embodiment, the water is mechanically removed using a vibration assisted rotary vacuum dewatering drum. In another non-limiting embodiment, the water is mechanically removed using a vibration assisted vacuum disk filter. In yet another non-limiting embodiment, the water is mechanically removed using a vibration assisted vacuum conveyor system.

The disclosed vibration assisted vacuum dewatering process operates to produce a coal particle filter cake that has a water content suitable for extrusion to form discrete, non-tacky pellets.

The following non-limiting examples are given to illustrate several embodiments relating to the vibration assisted vacuum dewatering processes and related apparatus. It is to be understood that these examples are neither comprehensive nor exhaustive of the many types of embodiments which can be practiced in accordance with the presently disclosed invention.

Example 1

General Comparison of Dewatering Processes

Laboratory tests show that the moisture content of the cake produced by mechanical dewatering techniques is dependent upon the particle size distribution. A gravity dewatering technique and different mechanical dewatering techniques were tested on coal-froth containing 95 wt. % coal particles on a dry basis with the particle size distribution shown in FIG. 1. The different dewatering techniques/equipment included a lab-scale thickener test, a pilot-scale screen-bowl centrifuge, a pilot-scale filter press, a pilot-scale vacuum dewatering drum, a vacuum ceramic disc filter, and a lab-scale tower press. The results are shown in Table 1.

TABLE 1

Comparison of Dewatering Techniques

| Dewatering Technique | Moisture Content of Froth (wt. %) | Moisture content of dewatered cake (wt.) |
|---|---|---|
| Thickener with flocculant (gravity) | 75% | 52% |
| Pilot-scale screen-bowl centrifuge | 55% | 31% |
| Pilot-scale filter press | 55% | 37% |
| Pilot scale vacuum dewatering drum | 55% | 31% |
| Ceramic disc filter | 55% | 26% to 30% |
| Tower Press | 55% | 23% |

Many coal particle flotation processes produce a froth that is as high as 85 wt. % to 90 wt. % moisture. As a result, a thickener is used to reduce the moisture content down to about 50 wt. %. The coal particle flotation technique that was employed prior to dewatering for these tests produces a froth that is less than 55 wt. % moisture. As such, a thickener is not necessary since the limit of gravity dewatering is already reached.

The target moisture content of the filter cake after dewatering the froth containing the coal particles with the particle size distribution shown in FIG. 1 is approximately 24 wt. % moisture. For the tested mechanical dewatering processes, the screen-bowl centrifuge lost approximately 78% of the dry solid material in the effluent, for which reason it was not considered a viable option. The cake of the filter press was too high in moisture content, for which reason it was discarded as a viable option. The tower press could hit target moisture content but the capital costs were prohibitively large, for which reason it was discarded as a viable option. The vacuum dewatering drum and the ceramic disc filter both produced filter cakes that were close to the target moisture content. Therefore, vacuum dewatering was considered a viable mechanical dewatering process if more water could be removed.

As stated above, it is less expensive to remove water from a suspension, slurry, or froth via mechanical dewatering techniques than via thermal dewatering techniques. The target moisture content of 24 wt. % in the experiments above is based upon an overall process objective to obtain a dewatered filter cake suitable to be extruded into pellets that can be subjected to a different final dewatering step. For this dewatered filter cake with the particle size distribution in FIG. 1, a moisture content greater than 27 wt. % to 28 wt. % is too wet to extrude into proper pellets. Above 27% wt. % to 28 wt. % moisture, the pellets stick to one another significantly and re-agglomerate into a glob of pellets or a thick paste depending on the moisture content.

After extrusion, the pellets maintain their shape (e.g., are discrete) and are not tacky (e.g., do not stick together and do not re-agglomerate). Pellets that stick together slightly but maintain their shape will break apart after final dewatering, but in so doing, will dust some. Pellets that re-agglomerate into a moist coal particle mass will not dry as quickly as discreet pellets, reducing the efficiency of the final dewatering step. All of the above problems can be eliminated by having a low enough moisture content for the particle size distribution being extruded. For the particle size distribution being tested (see FIG. 1), the moisture content must be below 28 wt. % moisture with a target moisture content of about 24 wt. % moisture to prevent all of the problems listed above.

Example 2

Thixotropic Nature of the Filter Cake

When handling the cakes produced with the different mechanical dewatering techniques listed in Table 1 at moisture contents between 30 wt. % to 38 wt. %, it was observed that cakes tended to flow more readily when shearing force was added to the cake. Furthermore, when the cake was laid out on a table and patted by hand, moisture would migrate to and pool at the surface of the cake. Vibration was applied to the cake on the table and two things happened: the cake flowed readily to produce a thinner cake on the table and water migrated to the surface of the cake and pooled there. The described observation of shear thinning or becoming less viscous when a shear force or vibration force is applied is characteristic of a thixotropic material.

An experiment was done to understand two things: (1) the effect of vibration on vacuum dewatering and (2) the influence particle size has on the moisture content of the cake that was produced via vacuum dewatering and vibration assisted vacuum dewatering. Coal-froth with the particle size distribution shown in FIG. 1 was passed through sieves with screen sizes of 355 μm, 300 μm, 250 μm, 150 μm, 106 μm, and 63 μm. The different particle size ranges were then dewatered in the laboratory using a 250 ml vacuum flask and a Buchner funnel on 1 μm filter paper. The vacuum being pulled was 28 inches of Hg. The results can be seen in Table 2.

In vacuum dewatering, as the final amount of water is removed to form the final cake, the cake will change from having a moist appearance to having a dry surface with cracks forming in the cake. The moisture content for the column labeled "Moisture Content Before Vibration" was collected immediately after the filter surface of the cake looked dry and cracks formed in the cake. Once cracks formed in the cake, water and air were not pulled through the bulk of the cake by the vacuum. Instead, air was pulled through the cracks by the vacuum. As a result, the amount of dewatering that occurred after crack formation in the cake was minimal to none. The moisture content for the column labeled "Moisture Content After Vibration" was measured after 1 minute of vibration being applied to the surface of the filter cake in the Buchner funnel. Vibration was applied with a DeWALT model DC530 vibrator. The frequency of vibration was 14,500 per minute.

It was observed that the moisture content is directly related to particle size. In tests both before and after vibration, as particle size went down, the moisture content of the filter cake increased. Additionally, the moisture content was reduced at every particle size range tested when vibration was applied for 1 minute. A major reason for the increase in moisture content as particle size decreased is that there is greater surface area to weight ratio for filter cake consisting of smaller particles in comparison to a filter cake consisting of larger particles. Without being bound by theory, it is presently believed that water is found in a filter cake in two locations: either in the void space between particles or bound to the surface of the particles. When cracks form in a cake during vacuum dewatering, the water in the void spaces is mostly removed. Thus, in large degree, only the water bound to the surface of the particles remains. Thus, as the surface area of the particles increases with decreasing particle size, the moisture content of the cake increases.

The thixotropic nature of the material and the ability to further dewater the cake with vibration assisted vacuum dewatering can be explained by the moisture adhered to the surface of the particles in the filter cake. When shear force or vibration is applied to the cake, some water bound to the surface of the particles is released from the surface of the particles and fills void spaces between particles. This water acts as a flow aid and allows the particles to move with respect to one another, resulting in the observed shear thinning and flow under vibration. When vibration is applied, some of the water is released from the surface of the particles and migrates to the cake surfaces. The water that migrated to the top surface of the cake pooled at the surface. The flow that was induced when vibration was applied at the surface of the cake sealed the breaks or cracks in the cake allowing the vacuum to be maintained. As long as vacuum was maintained and there was not a break in the cake through which the vacuum could pass, then the vacuum was being pulled through the entire surface area of the filter cake. Much of the water that released from the surface of the particles during vibration which either pooled at the surface of the filter cake or remained in the void space between particles in the bulk of the cake was pulled out of the cake because of the applied vacuum and thus dewatered the cake more than if no vibration were applied.

TABLE 2

Filter Cake Moisture Content Based upon Particle Size

| Particle Diameter (μm) | Moisture Content Before Vibration (wt. %) | Moisture Content After Vibration (wt. %) |
|---|---|---|
| greater than 355 | 11.2% | 9.4% |
| 300 to 355 | 11.6% | 9.7% |
| 250 to 300 | 12.8% | 10.7% |
| 150 to 250 | 22.9% | 19.0% |
| 106 to 150 | 20.1% | 16.5% |
| 63 to 106 | 24.9% | 20.1% |
| less than 63 | 33.7% | 27.0% |

TABLE 2-continued

| Filter Cake Moisture Content Based upon Particle Size | | |
|---|---|---|
| Particle Diameter (μm) | Moisture Content Before Vibration (wt. %) | Moisture Content After Vibration (wt. %) |
| Original Coal Sample | 29.6% | 24.3% |

Example 3

Figure 2A:
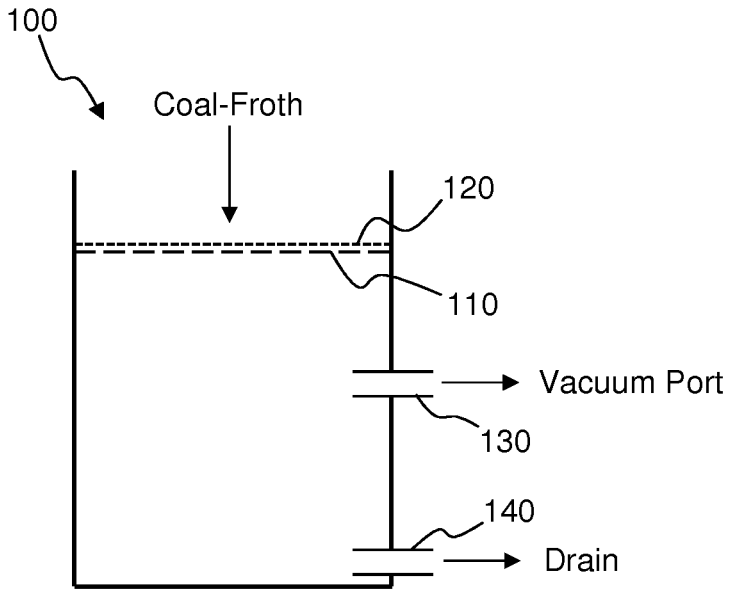
FIGS. 2A and 2B show features of a pilot-scale Buchner funnel vacuum dewatering unit.
Figure 2B:
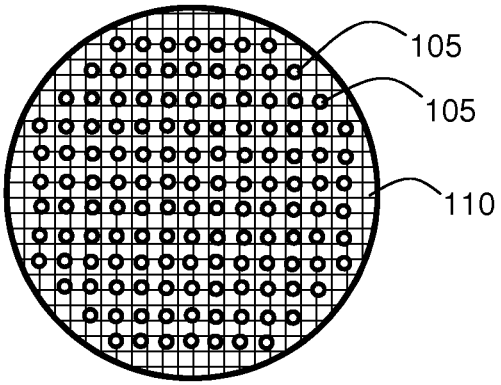

Vibration Assisted Dewatering in a Pilot-Scale Buchner Funnel Vacuum Dewatering System A pilot-scale Buchner funnel vacuum dewatering unit was made by modifying a 30 gallon stainless steel drum that is about 18 inches in diameter and 28 inches tall to process larger amounts of coal-froth. A schematic, cross-sectional representation of this pilot-scale Buchner funnel vacuum dewatering unit 100 is shown in FIG. 2A. One-half inch holes 105 were drilled into the lid 110 to support an overlying 55 μm mesh screen 120. FIG. 2B shows a schematic top view of the lid 110 with holes 105. A vacuum pump (Model SW-300-L manufactured by Shinko Seiki) was used to pull vacuum on the drum via a vacuum port 130. A drain 140 is provided to drain the water drawn through the screen 120 and holes 105. When just pumping air, this vacuum pulls more than 40 standard cubic feet per minute (SCFM) air through a 1 inch inside diameter tube. When coal-froth was poured onto the screen 120, a maximum vacuum of 25 inches Hg was pulled with 0 SCFM of air. 25 inches Hg vacuum was maintained as long as water was being pulled through the filter cake that built up on the screen. That is, the water formed a seal throughout the cake surface and prevented air from being pulled through the cake. Once air started to be pulled through the cake, the SCFM increased and the vacuum decreased. Table 3 shows the vacuum in inches Hg and air flow in SCFM measured at different points in the vacuum dewatering process.

Large cracks formed in the cake during vacuum drying, reducing the effectiveness of vacuum dewatering. These cracks acted as large leaks for the vacuum; the bulk of the air being pulled through the pump passed through the large cracks and not the filter cake. When there are large cracks, the pump pulled greater than 40 SCFMs of air and had no measurable vacuum pressure.

It was found that the cracks in the filter cake could be healed and dewatering enhanced by patting the filter cake by hand at a rate of about 60 oscillations per minute (OPM) (or a frequency of about 1 Hz) while vacuum was being pulled. In subsequent experiments, it was found that vibrating the surface of the cake also healed the cracks. The mechanized vibration was applied using a Vibco model SPWT-80 vibration unit that produces 3,200 oscillations per minute (or a frequency of about 53 Hz). The vibration unit was attached to an 8" plastic disc to and rubbed on the surface of the filter cake in circular motion like a hand sander. In another iteration, a Rockwell model RK5101K/RK5102K oscillating tool that produces 11,000 to 20,000 OPM (or frequencies ranging from about 183 Hz to about 333 Hz) was used to apply the vibration to the cake. Upon healing the cracks with the vibration unit, the air flow through the cake reduced from 40 to 10 and then 5 SCFM. The final vacuum pulled was 19" Hg at 5 SCFM. By healing the cracks, greater vacuum was achieved in the chamber, forcing water and air to be pulled through the bulk of the cake or entire volume of cake on the pilot-scale Buchner vacuum funnel, thus removing or dewatering more water out of the cake in comparison to before vibration when the cracks formed. The moisture content without vibration was 33 wt. %. The moisture content with vibration was 22 wt. %. See Table 3 and Table 4 for moisture contents under different operating conditions.

TABLE 3

Operation parameters of the lab-scale Buchner funnel-like vacuum dewatering unit under at different points in the vibration assisted vacuum dewatering test.

| | SCFMs | Pressure (inches Hg) | Moisture (wt. %) |
|---|---|---|---|
| No Cake | 40+ | 0" | — |
| Slurry on screen | 0 | 25" | 50 to 65 |
| Cake with big cracks | 40+ | 0" | 33 to 35 |
| During crack healing with vibrator | 10 | 12" | — |
| Final conditions during vibration before turning off the vacuum | 5 | 19" | 18 to 24 |

TABLE 4

Moisture of vacuum filter cake without treatment, with patting to heal cracks, or with vibration to heal cracks.

| | Moisture (wt. %) |
|---|---|
| No treatment | 33 to 35 |
| Patting (60 OPM) | 22 to 24.5 |
| Vibration (3,200 OPM) | 21 to 24 |
| Vibration (20,000 OPM) | 18 to 22 |

Example 4

Vibration Assisted Dewatering in a Komline-Sanderson Pilot-scale Vacuum Dewatering Drum A pilot-scale rotary drum vacuum filter (RDVF) device, manufactured by Komline-Sanderson, with a 1 foot face and a 3 foot drum diameter was used in this example. The RDVF device has a drum partially submerged in the coal-froth slurry to be dewatered. As the submerged portion of the drum rotates through the coal-froth, vacuum draws the liquid through the filter medium on the drum surface which retains the solids. The time the filter medium is submerged is called the filter cake formation time. When the filter cake builds up on the filter medium during the filter cake formation time exits the coal-froth and is no longer submerged, it rotates through air until the filter cake is discharged. The time the filter cake spends rotating through the air is called the drying time. The vacuum pulls air through the cake and continues to remove liquid as the drum rotates. The cake is removed or discharged from the drum surface before it re-enters the slurry to provide a continuous filter cake formation. The filtrate and air flow through the internal filtrate pipes through the rotary valve and into a vacuum receiver where the liquid is separated from the gas stream. Vacuum is developed by a liquid ring vacuum pump.

The original liquid ring pump was rated at 75 SCFM. Different tests were conducted on the rotary drum vacuum filter to understand the moisture level of filter cake product consisting of upgraded coal fines that could be expected from a vacuum dewatering drum. The coal-froth that was used to obtain these results was 55 wt. % water and 95 wt. % coal particles on a dry basis from upgraded coal fines with the particle size distribution shown in FIG. 1. Table 5 summarizes the operation parameters and moisture content results for the obtained filter cake under the stated conditions. In Table 5, "patting" was applied to some of the filter cakes to heal cracks and bring water to the surface of the cake to enhance dewatering. This is the same patting technique that was first found to work on the lab-scale Buchner-like vacuum dewatering device discussed above. When patting was applied to the pilot-scale rotary drum vacuum filter, it was done from the point on the drum where the cake exits the froth to the top of the drum, which is equivalent to a 90° cross-sectional slice of the vacuum dewatering drum.

TABLE 5

Operational parameters and moisture content of filter cake obtained using a Komline-Sanderson pilot-scale rotary drum vacuum filter and coal-froth containing 55 wt. % water and 45 wt. % upgraded coal fines.

| Input Parameters | | | | Output Parameters | | | |
|---|---|---|---|---|---|---|---|
| Run | Pump Size (SCFM) | Speed (minutes per revolution) | Patting | Gauge 1 (inches Hg) | Gauge 2 (inches Hg) | Cake Thickness (inches) | Cake Moisture (wt. % water) |
| 1 | 75 | 3 | no | 15" | 13" | ⅜ to ½ | 33 |
| 2 | 75 | 8.75 | yes | 20" | 18" | ⅜ to ½ | 28 |
| 3 | 200 | 3 | no | 25" | 23" | 5/16 | 26.7 |
| 4 | 200 | 3 | yes | 25" | 23" | 5/16 | 25.9 |
| 5 | 200 | 3 to 8.75 | yes | 25" | 23" | 5/16 | 24.5 |
| 6 | 200 | 8.75 | yes | 25" | 23" | 1⅛ to ⅞ | 26.9 |

The original tests with the 75 SCFM pump that came with the vacuum dewatering drum show that the moisture of the filter cake could be reduced from 33 to 28 wt. % moisture by applying patting (approximately 60 OPM) to the surface of the filter cake.

A higher capacity liquid ring pump was installed on the rotary drum vacuum filter. The larger pump was able to maintain a higher vacuum (as seen in Table 5) and pull more air through the cake. For example, moisture content of the cake without patting went from 33 wt. % water with the smaller pump to 26.7 wt. % water with the larger pump when no patting was applied (Run 1 and 3). Hence, maximizing vacuum on the vacuum dewatering drum and air flow through the cake are important parameters in dewatering the coal froth to a low moisture content filter cake.

Higher vacuum and air flow alone do not hit the target moisture content needed for the filter cake to be used in the extrusion pelletization process that follows vacuum dewatering for the particle size distribution of this sample as shown in FIG. 1. If pellets are extruded above 25.5 wt. % moisture or above, they tend to stick together in the drying processes. Above 27 wt. % moisture, they will re-agglomerate into globs of pellets or a thick paste after extrusion. The target moisture content for extrusion is between 23 and 24.5 wt. % moisture to ensure that the pellets do not stick together.

Further tests were run on the rotary drum vacuum filter with the larger pump in the attempt to optimize cake thickness and drying time to see if the target moisture content could be achieved for the upgraded coal fine filter cake. In run 4, with patting applied at the a drum speed of 3 minutes per revolution, the cake was 5/16" thick and 25.9 wt. % moisture. Although getting into the 25 wt. % moisture range was encouraging, it was still considered too high.

The cake thickness that built up on the drum at 3 minutes per revolution speed seemed ideal for further testing because of how well it dewatered in Run 4. In Run 5, 5/16" cake was allowed to build up on the rotary drum vacuum filter at 3 minutes per revolution while patting the filter cake. The drum speed was then turned 8.75 minutes per revolution. The slower speed allowed more air to be pulled through the filter cake before it was discharged. The moisture content of the resulting filter cake was 24.5 wt. %.

Although 24.5 wt. % moisture is on the high end of the target for extrusion, pellets extruded at this moisture content and particle size distribution do not stick to one another and can be fed downstream into the drying processes. The experimental results show that the target moisture content on the pilot-scale rotary drum vacuum filter could be reached through a combination of increased vacuum on the filtration drum and air flow through the cake obtained by adding a higher capacity pump and by also applying the patting/vibration technology to further dewater the filter cake as it is on the rotary drum vacuum filter.

Example 5

Influence of Vibration Oscillations Per Minute on Wt. % Moisture in Filter Cake

Two different vibration sources were tested with the pilot-scale Buchner funnel-like vacuum dewatering system: a Rockwell model RK5101K/RK5102K oscillating tool that produces between 11,000 to 20,000 oscillations per minute (OPM) and a Vibco SPWT-80 that produces 3,200 OPM.

Using no vibration source and these two vibration sources, four different vibration scenarios were tested with the pilot-scale Buchner funnel-like vacuum dewatering system. Both vibration sources were mounted on an 8" plastic disc. Vibration assisted dewatering was performed on filter cake produced with the pilot-scale Buchner funnel-like dewatering system by bringing the plastic disc in intimate contact with the formed filter cake once cracks started to form. Vibration was continuously applied until no further water was visibly coming to the surface of the cake, which generally took about 2 minutes.

In order to test the influence of OPM on the moisture content of the resulting filter cake, 6 kg of coal-froth at 34 wt. % solid was poured onto the lab-scale Buchner funnel-like vacuum dewatering system. From previous experience, cracks started to form at about the 9.5 minute mark. Vacuum was pulled without any vibration for about 9.5 minutes and then vibration was applied at 0, 3,200, 11,000, and 20,000 OPM for about 2 minutes. Table 6 shows the moisture content for the resulting filter cake for each OPM level. As the OPM increases, the moisture content in the cake goes down. It should be noted that if vibrations at 20,000 OPM are applied to a cake as soon as crack formation occurs, the cake flows more readily and smears around more than when vibrations at 3,200 OPM are applied. Additionally, lower moisture content is obtained for the sample with the particle size distribution shown in FIG. 1 as the oscillations per minute of the vibration unit increased. In other words, more water is released from the surface of the particles at higher oscillations per minute of the vibration unit.

TABLE 6

Moisture content in filter cake as a function of vibration frequency.

| Vibration Frequency (OPM) | Moisture Content after 5 minutes of vibration (wt. % water) |
|---|---|
| 0 | 28.9 |
| 3,200 | 23.25 |
| 11,000 | 22.9 |
| 20,000 | 21.6 |

Example 6

Adding Vibrators to a Pilot Scale Vacuum Dewatering Unit

Figure 3:
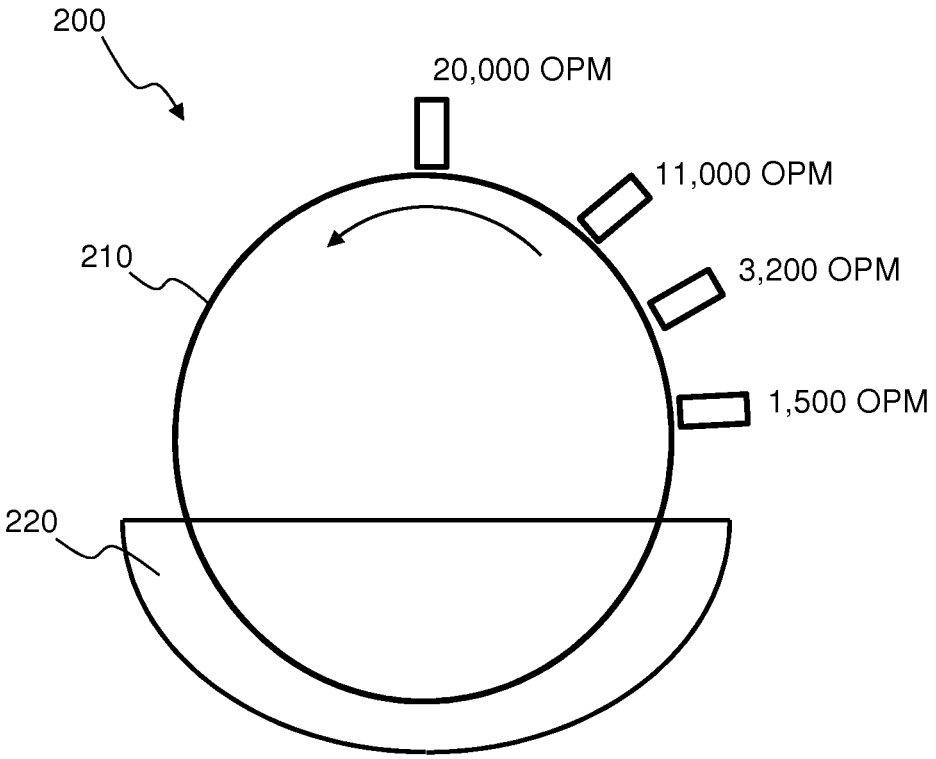
FIG. 3 shows a simplified cross-sectional representation of the location of vibration units and oscillations per minute for each vibration unit as installed on the WesTech pilot-scale vacuum dewatering drum.

A pilot-scale rotary drum vacuum filter device, manufactured by WesTech, with a 2 foot face and a 3 foot drum diameter was used in this example. A simplified cross-sectional representation of this vacuum dewatering device is shown in FIG. 3. Unlike the previous vacuum dewatering drum from Komline-Sanderson that was used, this pilot-scale rotary drum vacuum filter device 200 provided access to the whole surface of the vacuum dewatering drum 210 that was not submerged in the tank full of coal-froth 220 rather than about 40% of the surface area of the drum. The access to the vacuum dewatering drum allowed for vibration to be applied to the filter cake in three or four different locations. The drum was operated under conditions that are projected for commercial application of this technology on a full sized 10 foot diameter×20 foot long vacuum dewatering drum: 1 minute submergence (cake formation time) and 1 minute drying time for a total of 2 minutes per revolution. The cake thickness was consistently 7/16" when the froth was 55 wt. % moisture. Cracks formed in the cake almost immediately after exiting the bath with the froth. It was found that when vibration frequency (oscillations per minute) was too high when applied just before the point of crack formation, the cake smeared and fell off the filter drum surface and back into the bath of coal-froth. As a result, an air vibrator from Vibco with about 1,500 oscillations per minute was used at this point as shown in FIG. 3. FIG. 3 also shows the location and oscillations per minute for all the vibration units installed on the WesTech pilot-scale vacuum dewatering drum. Under the operation conditions stated above, the vacuum drum was operated continuously for 10 hours producing 2,100 pounds of filter cake at 23.7 wt. % moisture.

There are various mechanisms that can be used to provide vibration to the filter cake as it is produced. One non-limiting mechanism to provide vibration and/or patting to the surface of the filter cake is a mechanical camshaft driven system, such as the device described in U.S. Provisional Patent Application No. 61/985,721, filed Apr. 29, 2014, titled CAMSHAFT MECHANISM FOR APPLYING VIBRATION TO THE SURFACE OF FILTER CAKE, which disclosure is incorporated by reference. The camshaft mechanism drives a vibrating platform that contacts the surface of the filter cake at a desired vibrating frequency. One or more push rods are attached to the vibrating platform. Springs are provided to either urge the vibrating platform away from or towards the filter cake. The push rods engage corresponding cams on the camshaft. The cams push against the pushrods and spring to produce vibrating motion of the vibrating platform against the filter cake. The cams may be single-, double-, triple, or multi-lobed cams to produce multiple up and down cycles of the vibrating platform in one revolution of the camshaft. The axle or shaft of the camshaft is rotated quickly with a motor causing the vibration platform to go up and down, "patting" the filter cake on the vacuum drum with a frequency dependent upon the rotations per minute of the camshaft. The camshaft driven patting unit was also installed on the drum and shown to provide the same dewatering effect as electronic or air driven vibration units as described above.

Example 7

Figure 4A:
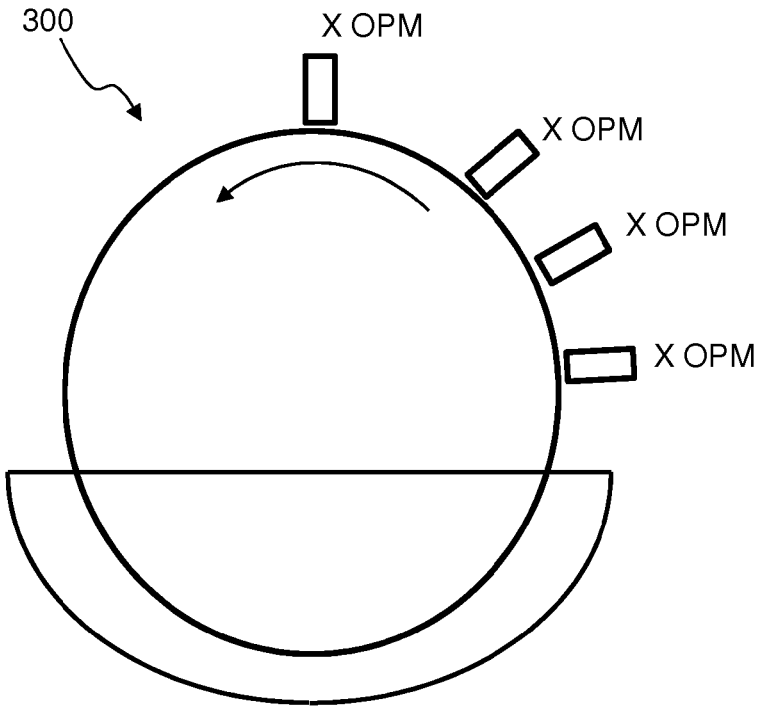
FIGS. 4A and 4B show examples of vibration sources placed on a vacuum dewatering system to assist in the dewatering process.
Figure 4B:
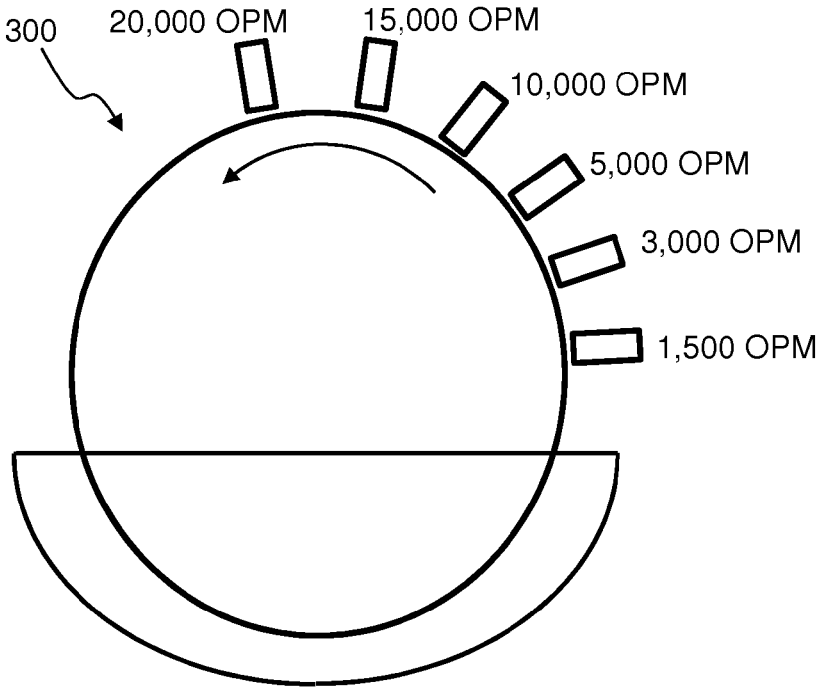

Placement of Vibration Sources on a Vacuum Dewatering Drum or Vacuum Ceramic Filter to Assist in Vacuum Dewatering Processes Vibration sources can be placed at multiple fixed locations on a rotary vacuum system to heal cracks and bring water to the surface of the cake in order to assist in dewatering of the filter cake. FIGS. 4A and 4B provide non-limiting examples how the vibration sources could be placed in multiple locations on a vacuum dewatering system to improve the performance of the vacuum dewatering system and achieve lower moisture contents in the filter cake. FIGS. 4A and 4B are intended for illustration purposes and are not intended to denote an exact number of vibration sources or the exact optimized frequency that should be used to achieve a target moisture content in the filter cake.

FIG. 4A shows that the vibration sources could all be set to a fixed OPM. FIG. 4B shows that the vibration sources could be set at different OPMs to optimize the dewatering process. For example, it has been observed that 1,500 OPM does not cause as much movement in the cake nor bring as much moisture to the surface as higher vibration frequencies. When the cake is the wettest, just after exiting the froth bath on the vacuum dewatering system, it may be advantageous to use a lower OPM to just heal the cake and not bring too much water to the cake surface since the filter cake is very moist at this point. The OPMs could be increased at each ensuing vibration point to heal cracks that form in the cake and bring water to the surface at each point more aggressively since the cake is dryer at each vibration point. FIG. 4B illustrates one non-limiting configuration of increasing vibration frequency as the filter cake is being dewatered, ranging from 1,500 OPM to 20,000 OPM.

A further variation is that the OPM of the vibration points and the speed of the vacuum dewatering drum could be controlled in concert with a filter cake moisture content monitoring feedback loop to ensure that the cake exits the vacuum dewatering system with the target moisture content.

Example 8

Figure 5:
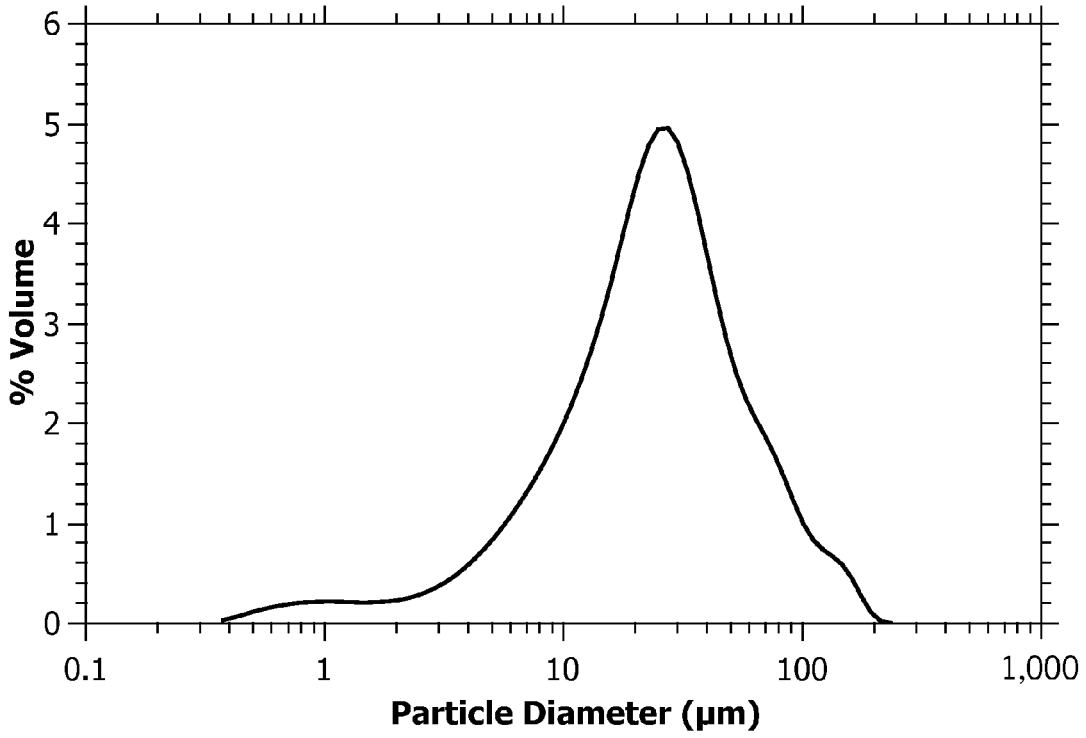
FIG. 5 shows a particle size distribution for coal particles from a different coal fines source used in Example 8.

Particle Size Distribution Influences the Moisture Content that can be Reached Via Normal Vacuum Dewatering and Vibration Assisted Vacuum Dewatering FIG. 5 shows the particle size distribution for coal particles from a different coal fines source. As can be seen, the particles are much smaller than the particles shown in FIG. 1 with an average particle size of about 40 μm. When coal-froth from these coal fines is dewatered with the pilot-scale Buchner funnel dewatering system, the moisture content at crack formation was 36 wt. %. After vibration, the moisture content was 30 wt. %. By eye and feel, the filter cake seemed to be as dry as 24 wt. % filter cake for the cake made from the froth with the particle size distribution shown in FIG. 1. Without being bound by theory, it is presently believe that the reason for the higher moisture content for the particle size distribution shown in FIG. 5 is that the smaller particle size has a larger overall surface area to weight ratio. Therefore, more water remains bound to the surface of the particles after vacuum dewatering and vibration assisted vacuum dewatering.

The surprising outcome is that filter cakes at 24 wt. % moisture for the particle size distribution in FIG. 1 and 30 wt. % moisture for the particle size distribution in FIG. 5 could both be extruded without the pellets sticking together and re-agglomerating into globs of pellets or a thick paste after extrusion. Regardless of the particle size distribution, vacuum dewatering alone may leave some water in the void space between particles of the filter cake and does not remove any surface bound water from the filter cake, resulting in a filter cake that is too wet to extrude without the pellets sticking together and re-agglomerating into globs of pellets or a thick paste after extrusion. In contrast, regardless of the particle size distribution, when vibration assisted vacuum dewatering is used, nearly all the water is removed from the void space in between particles. Furthermore, the vibration removes some surface bound water as well and allows it to be removed from the cake by the vacuum. As a result, regardless of particle size distribution, filter cakes produced via vibration assisted vacuum dewatering can be extruded without the pellets sticking together and re-agglomerating after extrusion.

Example 9

Washing Filter Cake to Remove Salts

Sulfur exists in coal in three main forms: organic sulfur (thiol groups that are part of the coal matrix), pyritic sulfur (iron sulfide that is part of the mineral matter), and sulfate salts (part of the mineral matter). When coal is burned with high sulfur content, the sulfur in the coal is converted into $SO_x$, and is considered to be a harmful air pollutant that contributes to acid rain among other harmful effects. Froth flotation can serve to reduce pyritic sulfur because it can be separated from the hydrophobic coal in the froth flotation separation process. During froth flotation, sulfate salts tend to dissolve into the water. Water in the froth will contain some dissolved sulfate salts. Furthermore, other dissolved salts such as NaCl are also present in many coal samples. Coal buyers place a premium on coal products where the salt content in any form is minimized.

It is understood that a filter cake made by dewatering coal flotation froth still contains some of the water used in the flotation separation process. For instance, the filter cake may contain 35 wt. %, 30 wt. %, 25 wt. %, or some other weight percent water. The remaining water necessarily contains some of the salts dissolved during the flotation separation process. When the water is removed completely from the cake in subsequent processes such as final dewatering after pelletization, the salts precipitate out as a solid and remain in the final pellet product.

The advantage of vibration assisted dewatering is that more water is removed from the filter cake, thus carrying more of the dissolved salts out of the cake with the filtrate water. Even after vibration assisted vacuum dewatering, there are still dissolved salts that remain in the water in the filter cake.

In this example, a mist of wash water was sprayed onto the filter cake and allowed to be pulled through the filter cake by the vacuum. The goal was to rinse as much of the dissolved salts out of the filter cake and into the filtrate water as possible to minimize the presence of dissolved salts that precipitate during subsequent drying to produce the final pellet product. Enough wash water was added to the cake to displace the water in the cake one time.

Table 7 shows the results for the vacuum dewatering and washing experiment described above. After dewatering the froth via vibration assisted vacuum dewatering, sulfate salt reduced 36% from 0.5 wt. % to 0.32 wt. %. NaCl salt reduced 50% from 0.1 wt. % to 0.05 wt. %. After washing the filter cake, the sulfate salt was reduced all the way down to 0.04 wt. % from 0.32 wt. %, a reduction of 87.5%. After washing the filter cake, the NaCl left behind was reduced by 20%. If the total sulfur content of a coal is at or below 1.0 wt. % on a dry basis, minimal to zero post combustion scrubbing is needed to meet current $SO_x$ emission regulations. The data herein demonstrates that washing filter cake can bring each salt content (sulfate and NaCl salts were the examples demonstrated here) to below 0.1 wt. %.

TABLE 7

Salt content of coal sample at various stages in the refining process. All values are in wt. % and are reported on a dry basis.

| Sample State | Sulfate Sulfur (wt. %) | NaCl (wt. %) |
|---|---|---|
| Slurry before flotation | 0.5% | 0.1% |
| Filter Cake of Froth after flotation | 0.32% | 0.05% |
| Washed Filter Cake of froth after flotation | 0.04% | 0.04% |

Example 10

Filter Cake Formation and Drying Time

Figure 6:
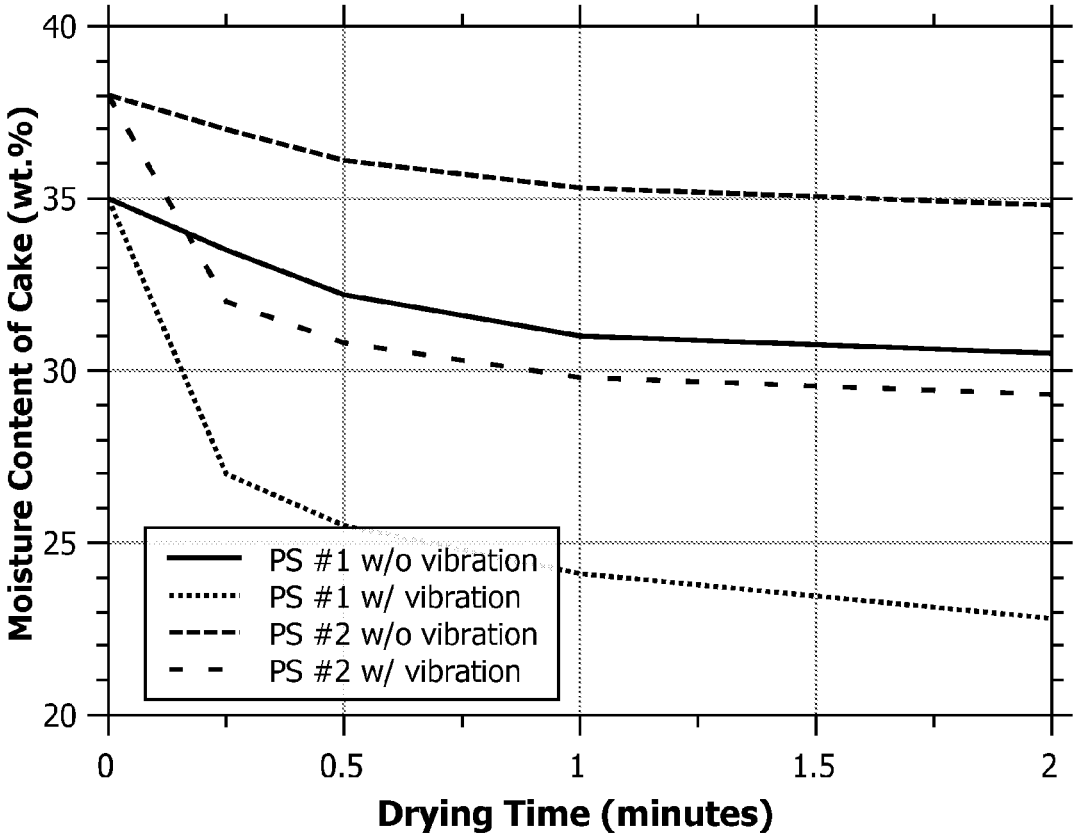
FIG. 6 is a graph showing moisture content of the filter cake as a function of the drying time, with and without vibration, for two different particle size distributions.

In vacuum dewatering, there are two main processes: cake formation time and drying time. The cake formation time occurs when the vacuum filter is immersed in the slurry or froth, which is a suspension of particles to be dewatered. During this time, water is sucked through the filter by the vacuum leaving the particles behind to form a filter cake on the filter that increases in thickness with increasing cake formation time. Experimentation in the lab has shown that when applying vacuum dewatering for a particles size distributions similar to PS #1 (FIG. 1) and PS #2 (FIG. 5), filter cake thickness of about 9 mm forms for a 1 minute cake formation time if the coal-froth is about 50 wt. % solid. The drying time is then the time that vacuum is pulled through the cake to remove as much water or moisture from the cake as possible until the cake is discharged from the vacuum dewatering unit. FIG. 6 plots moisture content of filter cakes made from PS #1 and PS #2 using a 50 wt. % solids coal froth and a 1 minute cake formation time. At a drying time of 0 minutes, filter cakes start out at PS #1 and PS #2 having 35 wt. % moisture and 38 wt. % moisture, respectively.

The data shows that the application of vibration significantly reduces the moisture content of the filter cake for both particle sizes. The filter cake made from PS #1 reached about 24 wt. % moisture in one minute of drying time, and filter cake made with PS #2 reached about 31 wt. % moisture in one minute of drying time. PS #2 has a higher moisture content because of the smaller particles sizes have an overall greater surface area, resulting in more moisture being bound to the surface of the particles. As indicated by the data below, for a give particle size distribution in the slurry or froth suspension of particles in water, vibration assisted vacuum dewatering is very effective in reducing the moisture content of the filter cake to levels that cannot be achieved via traditional vacuum dewatering alone.

As discussed above in relation to FIG. 6, The filter cake for PS #1 is 35 wt. % moisture and the filter cake for PS #2 is 38 wt. % moisture at the end of the cake formation time and before beginning the drying time. This means that at the start of the drying time in the vacuum dewatering cycle, the filter cake for the "without" (w/o) vibration test and the "with" (w/) vibration test have the same amount of water in them. The amount of water removed during the drying time was measured for different drying time lengths. The results are plotted in FIG. 7 as the wt. % of water removed during drying time as a function of time. The wt. % water removed was calculated as the mass of water collected by the vacuum dewatering divided by the mass of water in the cake before the drying time started. In this manner, one can see how much of the water that was in the cake at the start of the drying time is removed with (w/) and without (w/o) vibration for different drying times.

Figure 7:
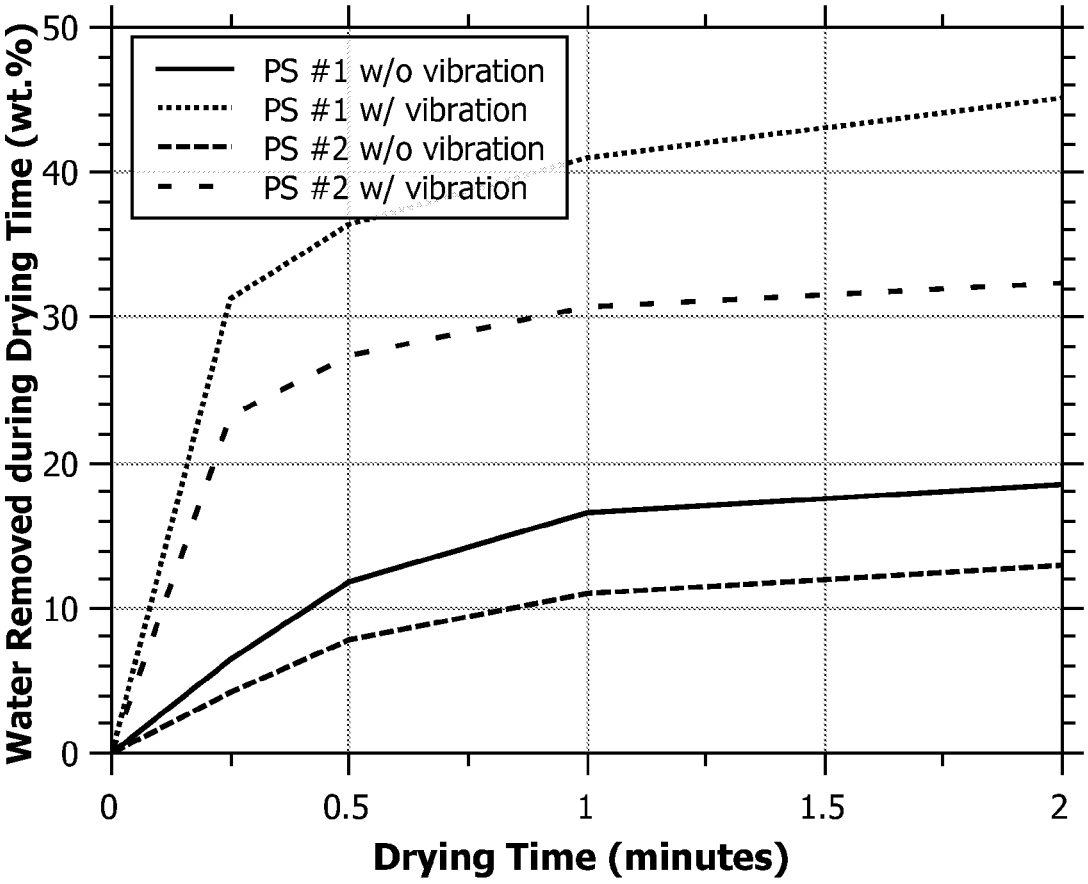
FIG. 7 is a graph showing water removed (wt. %) as a function of drying time, with and without vibration, for two different particle size distributions.

As can be seen in FIG. 7, the advantage of vibration assisted vacuum dewatering is that significantly more water is removed from the filter cakes with PS #1 or PS #2 in the first 15 seconds of drying time than when vibration is not used in vacuum dewatering. Greater than 30 wt. % of the water remaining in the filter cake at the start of the drying time was removed from the filter cake in the first 15 seconds of vibration assisted vacuum dewatering for PS #1. Greater than 20 wt. % of the water remaining in the filter cake at the start of the drying time was removed from the filter cake in the first 15 seconds of vibration assisted vacuum dewatering for PS #2. In contrast, less than 10 wt. % of the water remaining in the filter cake at the start of the drying time was removed from the filter cake in the first 15 seconds of vacuum dewatering without vibration for either PS #1 and PS #2.

After 1 minute of vacuum dewatering without vibration, less than 20 wt. % for PS #1 and less than 15 wt. % for PS #2 of the water remaining in the filter cake at the start of the drying time was removed from the filter cake. After 1 minute of vibration assisted vacuum dewatering, greater than 40 wt. % for PS #1 and greater than 30 wt. % for PS #2 of the water remaining in the filter cake at the start of the drying time was removed from the filter cake.

After 2 minute of vacuum dewatering without vibration the trend remain where less than 20 wt. % for PS #1 and less than 15 wt. % for PS #2 of the water remaining in the filter cake at the start of the drying time was removed from the filter cake. After 2 minute of vibration assisted vacuum dewatering, greater than 40 wt. % for PS #1 and greater than 30 wt. % for PS #2 of the water remaining in the filter cake at the start of the drying time was removed from the filter cake.

In a commercial process using vacuum dewatering, two important parameters for process performance are (1) the moisture content of the cake as it discharges from the vacuum dewatering system and (2) the throughput of the system, e.g. the amount of filter cake the vacuum dewatering system produces at the target moisture content per unit time. If throughput is low, then more vacuum dewatering units are needed to produce the desired throughput. The results shown in FIGS. 6 and 7 illustrate the importance of vibration assisted dewatering in developing a dewatering process that meets both moisture content targets and throughput targets. FIG. 6 shows that vibration assisted vacuum dewatering produces filter cakes with significantly less moisture for PS #1 and PS #2. The speed at which the moisture contents are reached in FIG. 6 and speed at which water is removed as shown in FIG. 7 as a wt. % water removed needs to be emphasized. Greater than 20 wt. % of the water remaining in the filter cake at the start of the drying time is removed from the filter cake in first 15 seconds of drying time with vibration assisted vacuum dewatering for PS #1 and PS #2. The speed of water removal in the first 15 seconds of vibration assisted vacuum dewatering is important when compared to the results for vacuum dewatering without vibration. Less than 20 wt. % of the water remaining in the filter cake at the start of the drying time is removed from the filter cake after 2 minutes of drying time for vacuum dewatering without vibration for PS #1 and PS #2. Or, in other words, more of the water remaining in the filter cake at the start of the drying time is removed from the filter cake in first 15 seconds of drying time with vibration assisted vacuum dewatering for PS #1 and PS #2 than in 2 minutes of drying time for vacuum dewatering without vibration for PS #1 and PS #2.

Figure 8:
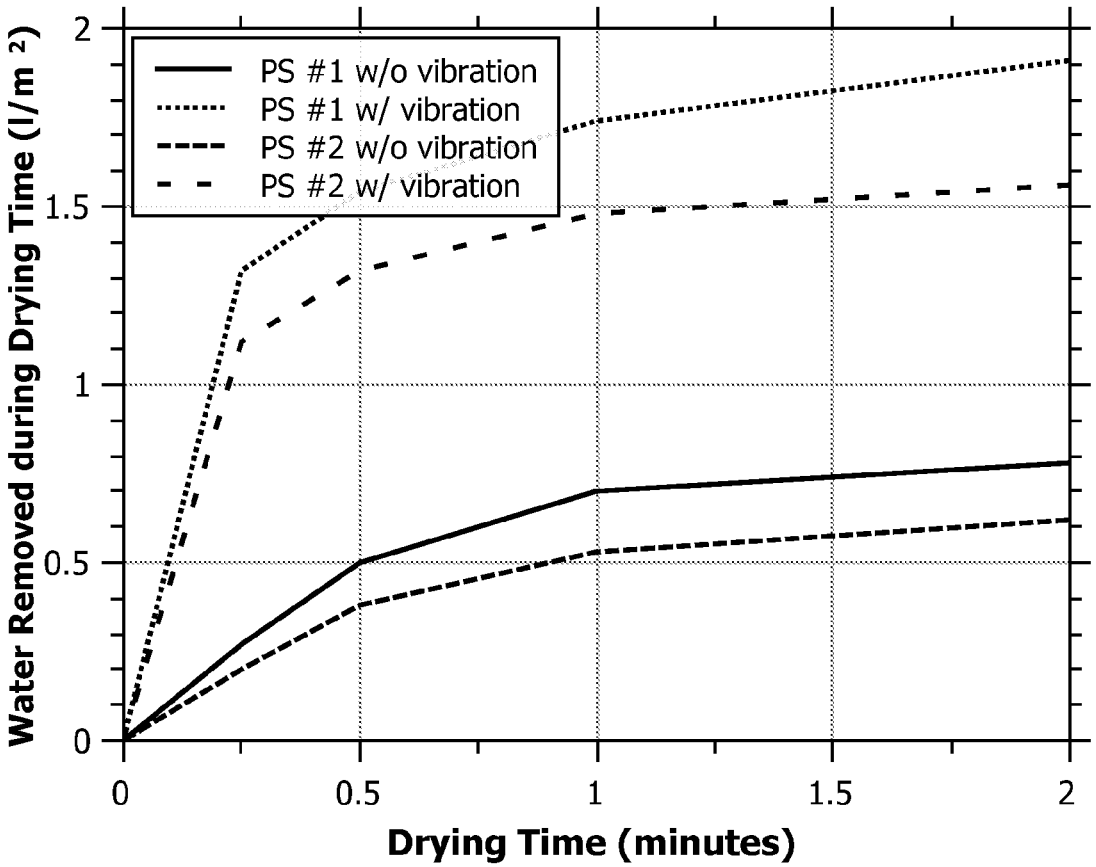
FIG. 8 is a graph showing water removed (liters/square meter) as a function of drying time, with and without vibration, for two different particle size distributions.

FIG. 8 shows water removed during the drying time in units of liters water per square meter area of the vacuum dewatering unit ($l/m^2$) plotted as a function of drying time. This is the same plot as FIG. 7, but with different units on the y-axis. The amount of water in the filter cakes at the beginning of the drying time was 4.2 $l/m^2$ and 4.8 $l/m^2$ respectively for filter cakes PS #1 and PS #2. Less than 0.3 $l/m^2$ of the water remaining in the filter cake at the start of the drying time was removed from the filter cake in the first 15 seconds of vacuum dewatering without vibration for either PS #1 and PS #2. Importantly, greater than 1.0 $l/m^2$ of the water remaining in the filter cake at the start of the drying time was removed from the filter cake in the first 15 seconds of vibration assisted vacuum dewatering for both PS #1 and PS #2.

An initial water removal rate can be obtained from the slope of the steep, linear portion of the curves in FIG. 8 at the start of the drying time. These water removal rates are listed in Table 8. Initial water removal rates for vacuum dewatering without vibration were less than 1 $l/m^2$/min. Initial water removal rates for vibration assisted vacuum dewatering were greater than 4.3 $l/m^2$/min.

TABLE 8

Initial water removal rate of the water remaining in the filter cake at the start of the drying time (for up to 15 seconds of drying time).

| Filter Cake Size | Water Removal Rate ($l/m^2$/minute) | |
|---|---|---|
| Distribution | w/o vibration | w/vibration |
| PS #1 | 0.9 | 5.3 |
| PS #2 | 0.7 | 4.5 |

Figure 9:
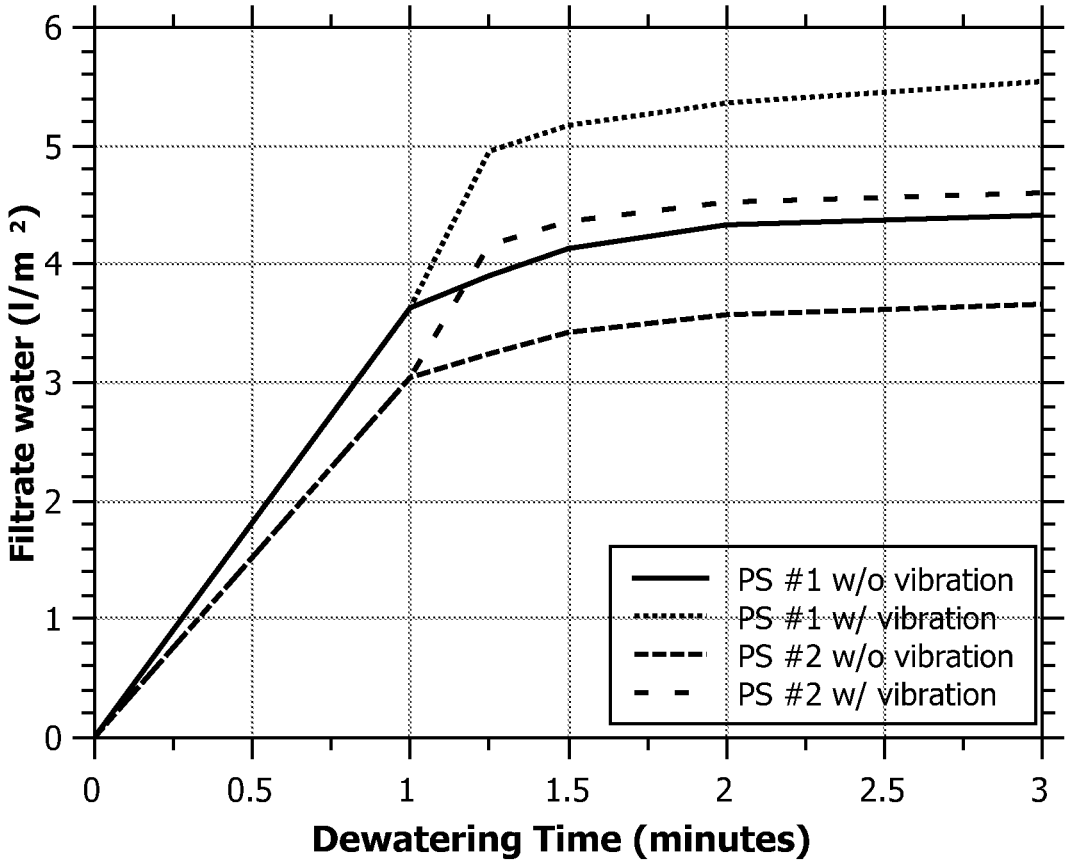
FIG. 9 is a graph showing filtrate water removed (liters/square meter) as a function of dewatering time, with and without vibration, for two different particle size distributions.

FIG. 9 plots filtration water as a function of dewatering time. Dewatering time is the cake formation time plus the drying time before discharging the filter cake. The cake formation time was constant at 1 minute, producing a filter cake approximately 9 mm in thickness. The drying time before discharging the cake was varied up to 2 minutes. Filtration water is measured in $l/m^2$ and is the total amount of water collected during vacuum dewatering.

The interesting thing to note is that when vibration assisted vacuum dewatering is used during the drying time, the initial slope of the water removal is nearly the same as for water removal during the cake formation time for either PS #1 or PS #2. When vacuum dewatering is done without vibration, there is an immediate reduction in the slope at the transition from the cake formation time to the drying time (1 minute mark). The slope of this curve can be considered the rate of water removal or the dewatering rate, and it has the same units as Table 8, e.g. $l/m^2/min$.

Without being bound by theory, it is presently believed the reason the rate of water removal during cake formation time and the initial rate of water removal for vibration assisted vacuum dewatering during the drying time are nearly the same can be explained as follows. During cake formation time, the filter is immersed in the froth being dewatered. Water is always being pulled through the filter, and air is never pulled through the filter. As soon as air is pulled through the filter, the water removal rate goes down. Thus, the water removal rate is maximized during the cake formation time. As discussed above, when vibration is applied to a filter cake, some of the water molecules on the surface of the solid particles in the filter cake leave the surface of the solid particles and fill the void space between particles. During the initial portion of the drying time in vacuum dewatering, if vibration is applied, the water that is removed by the vacuum can be replaced with water leaving the surface of the solid particles. During this time, only water and no air is still always passing through the filter. Thus the water removal rate is still maximized. At some point, water molecules are no longer filling the void space in the cake even when vibration is applied, so air can pass through the filter cake. As soon as air begins to pass through the filter cake, the water removal rate goes down as evidenced by the onset reduced slope in FIG. 9. In the case when no vibration is used during the drying time of vacuum dewatering, immediately air is able to pass through the filter cake, resulting in a reduced slope and thus a reduced dewatering rate.

Table 9 shows the average dewatering rate for the different curves from FIG. 9 at different time intervals. The average dewatering rate for vibration assisted dewatering is nearly the same all the way up to about 1.25 minutes (1 minute of cake formation time and 0.25 minute of drying time) because, as discussed above, vibration assisted dewatering maintains a maximized the dewatering rate during the initial stages of drying time. For vacuum dewatering without vibration, the average reduces as soon as the cake formation time ends at about 1 minute because air is also being pulled through the cake causing the dewatering rate to go down. The average dewatering rate indicates the total amount of water in the filtrate, e.g. clarified water removed from the slurry and discharged by the vacuum dewatering unit. For a dewatering cycle time of 2 minutes (1 minute cake formation time and 1 minute drying time), the average dewatering rate is 2.2 $l/m^2/min$. without vibration and 2.7 $l/m^2/min$. with vibration for a froth with particle size distribution PS #1. For a dewatering cycle time of 2 minutes (1 minute cake formation time and 1 minute drying time), the average dewatering rate is 1.8 $l/m^2/min$. without vibration and 2.3 $l/m^2/min$. with vibration for a froth with particle size distribution PS #2. As discussed above, particle size distribution PS#2 is near the lower limit of particle sizes that can be dewatered without losing too many particles in the filtrate and blinding the filter such that dewatering times grow too long. Average dewatering rates for froths with particles size distributions similar to PS #2 are near the lowest rates that we expect to achieve with either vibration assisted vacuum dewatering or vacuum dewatering without vibration.

TABLE 9

Average dewatering rate when vacuum dewatering a coal-froth with particle size distribution PS #1.

| Dewatering Time | Average Dewatering Rate ($l/m^2/minute$) | |
|---|---|---|
| (minutes) | w/o vibration | w/vibration |
| 1.0 | 3.6 | 3.6 |
| 1.25 | 3.1 | 4.0 |
| 1.5 | 2.75 | 3.5 |
| 2.0 | 2.2 | 2.7 |
| 3.0 | 1.5 | 1.9 |

TABLE 10

Average dewatering rate when vacuum dewatering a coal-froth with particle size distribution PS #2.

| Dewatering Time | Average Dewatering Rate ($l/m^2/minute$) | |
|---|---|---|
| (minutes) | w/o vibration | w/vibration |
| 1.0 | 3.0 | 3.0 |
| 1.25 | 2.6 | 3.3 |
| 1.5 | 2.3 | 2.9 |
| 2.0 | 1.8 | 2.3 |
| 3.0 | 1.2 | 1.5 |

From the foregoing description, it will be appreciated that the disclosed invention provides vibration assisted vacuum dewatering systems and methods for dewatering fine coal particles to form a filter cake. The disclosed vibration assisted vacuum dewatering systems and methods may produce a coal particle filter cake suitable for extrusion to form discrete, non-tacky pellets.

The described embodiments and examples are all to be considered in every respect as illustrative only, and not as being restrictive. The scope of the invention is, therefore, indicated by the appended claims, rather than by the foregoing description. All changes that come within the meaning and range of equivalency of the claims are to be embraced within their scope.

The invention claimed is:

1. A process for removing water from coal particles comprising:

obtaining a quantity of wet coal particles collected from coal fines that were processed to remove ash-forming component particles, wherein the coal particles have a particle size less than about 500 μm; and mechanically removing water from the wet coal particles by vibration assisted vacuum dewatering to form a coal particle filter cake having a water content less than 35% by weight, the vibration assisted vacuum dewatering comprising:

placing at least one vibration source on a surface of the coal particle filter cake; and vibrating the at least one vibration source at a frequency in the range of about 1 Hz to about 500 Hz.

2. The process according to claim 1, wherein the vibration assisted vacuum dewatering further comprises increasing the frequency as the water content of the coal particle filter cake is decreased.

3. The process according to claim 1, wherein the coal particle filter cake is formed on a vibration assisted rotary vacuum dewatering drum.

4. The process according to claim 1, wherein the coal particle filter cake is formed on a vibration assisted vacuum disk filter.

5. The process according to claim 1, wherein the coal particle filter cake is formed on a vibration assisted vacuum conveyor system.

6. The process according to claim 1, wherein, after the vibration assisted vacuum dewatering, the coal particle filter cake has a water content suitable for extrusion to form discrete, non-tacky pellets.

7. The process according to claim 1, wherein the coal particles have a particle size less than about 300 μm.

8. The process according to claim 1, wherein the coal particles have a particle size less than about 150 μm.

9. The process according to claim 1, wherein the coal particles have a particle size less than about 100 μm.

10. The process according to claim 1, wherein the coal particles have a particle size less than about 75 μm.

11. The process according to claim 1, wherein the step of mechanically removing water from the wet coal particles by vibration assisted vacuum dewatering forms a coal particle filter cake having a water content less than 30% by weight.

12. The process according to claim 1, wherein the step of mechanically removing water from the wet coal particles by vibration assisted vacuum dewatering forms a coal particle filter cake having a water content less than 25% by weight.

13. The process according to claim 1, further comprising, during the vibration assisted vacuum dewatering, washing the coal particle filter cake with wash water to remove soluble contaminants.

14. The process according to claim 13, wherein the soluble contaminants include soluble sulfate salts.

15. The process according to claim 13, wherein the soluble contaminants include soluble chloride salts.

16. The process according to claim 1, wherein the vibration assisted vacuum dewatering causes water to initially be removed from the coal particle filter cake at a rate greater than 1.5 $l/m^2/min$.

17. the process according to claim 16, wherein the vibration assisted vacuum dewatering causes water to initially be removed from the coal particle filter cake at a rate greater than 2 $l/m^2/min$.

18. The process according to claim 1, wherein the vibration assisted vacuum dewatering causes the water content of the coal particle filter cake to be reduced by at least 10 wt. % within 15 seconds.

19. The process according to claim 18, wherein the vibration assisted vacuum dewatering causes the water content of the coal particle filter cake to be reduced by at least 20 wt. % within 30 seconds.

20. The process according to claim 18, wherein the vibration assisted vacuum dewatering causes the water content of the coal particle filter cake to be reduced by at least 30 wt. % within 60 seconds.

21. The process according to claim 1, wherein the vibration assisted vacuum dewatering causes the water content of the coal particle filter cake to be reduced at an average rate greater than 2.3 liters/square meter/minute for a dewatering time of 2 minutes.

22. The process according to claim 1, wherein the vibration assisted vacuum dewatering causes the water content of the coal particle filter cake to be reduced at an average rate greater than 1.5 liters/square meter/minute for a dewatering time of 3 minutes.

23. A process for removing water from coal particles comprising:

obtaining a quantity of wet coal particles collected from coal fines that were processed to remove ash-forming component particles, wherein the coal particles have a particle size less than about 300 μm; and mechanically removing water from the wet coal particles by vibration assisted vacuum dewatering to form a coal particle filter cake having a water content less than 30% by weight such that the particle filter cake is suitable for extrusion to form discrete, non-tacky pellets, wherein the vibration assisted vacuum dewatering comprises:

placing at least one vibration source on a surface of the coal particle filter cake;

vibrating the at least one vibration source at a first vibration frequency in the range from about 1 Hz to about 500 Hz for a first period of time; and vibrating the at least one vibration source at a second vibration frequency higher than the first vibration frequency for a second period of time subsequent to the first period of time such that the vibration frequency is increased as the water content of the coal particle filter cake is decreased.

24. The process according to claim 23, wherein the coal particles have a particle size less than about 150 μm.

25. The process according to claim 23, wherein the coal particles have a particle size less than about 100 μm.

26. The process according to claim 23, wherein the coal particles have a particle size less than about 75 μm.

27. The process according to claim 23, wherein the step of mechanically removing water from the coal particles by vibration assisted vacuum dewatering forms a coal particle filter cake having a water content less than 25% by weight.

28. The process according to claim 23, further comprising, during the vibration assisted vacuum dewatering, washing the coal particle filter cake with wash water to remove soluble contaminants.

29. The process according to claim 28, wherein the soluble contaminants include soluble sulfate salts.

30. The process according to claim 28, wherein the soluble contaminants include soluble chloride salts.

31. The process according to claim 23, wherein the vibration assisted vacuum dewatering causes water to initially be removed from the coal particle filter cake at a rate greater than 1.5 $l/m^2/min$.

32. The process according to claim 31, wherein the vibration assisted vacuum dewatering causes water to initially be removed from the coal particle filter cake at a rate greater than 2 $l/m^2/min$.

33. The process according to claim 23, wherein the vibration assisted vacuum dewatering causes the water content of the coal particle filter cake to be reduced by at least 10 wt. % within 15 seconds.

34. The process according to claim 33, wherein the vibration assisted vacuum dewatering causes the water content of the coal particle filter cake to be reduced by at least 20 wt. % within 30 seconds.

35. The process according to claim 33, wherein the vibration assisted vacuum dewatering causes the water content of the coal particle filter cake to be reduced by at least 30 wt. % within 60 seconds.

36. The process according to claim 23, wherein the vibration assisted vacuum dewatering causes the water content of the coal particle filter cake to be reduced at an average rate greater than 2.3 liters/square meter/minute for a dewatering time of 2 minutes.

37. The process according to claim 23, wherein the vibration assisted vacuum dewatering causes the water content of the coal particle filter cake to be reduced at an average rate greater than 1.5 liters/square meter/minute for a dewatering time of 3 minutes.

* * * * *